US008479422B1

(12) United States Patent
Kato et al.

(10) Patent No.: US 8,479,422 B1
(45) Date of Patent: Jul. 9, 2013

(54) ELECTRONIC SHELF LABEL WITH INTERNAL INFORMATION

(75) Inventors: Syuzoh Kato, Hiratsuka (JP); Yoshitaka Utsumi, Kanagawa (JP); John Peter Roquemore, III, Snellville, GA (US)

(73) Assignee: NCR Corporation, Duluth, GA (US)

( * ) Notice: Subject to any disclaimer, the term of this patent is extended or adjusted under 35 U.S.C. 154(b) by 1358 days.

(21) Appl. No.: 11/005,715

(22) Filed: Dec. 7, 2004

(51) Int. Cl.
*G09F 3/20* (2006.01)

(52) U.S. Cl.
USPC ..... 40/451; 235/383; 40/642.02; 40/657

(58) Field of Classification Search
USPC ..... 40/448, 50, 444, 642.02, 124.01, 40/363, 442, 453, 489, 546, 570, 642.01; 235/375–386; 345/172, 4–5, 50
See application file for complete search history.

(56) References Cited

U.S. PATENT DOCUMENTS 4,073,612 A * 2/1978 Nitta ..... 431/126
4,096,656 A * 6/1978 Diceglie ..... 40/564
4,514,920 A * 5/1985 Shafrir et al. ..... 40/448
4,768,300 A * 9/1988 Rutili ..... 40/546
4,805,331 A * 2/1989 Boggess et al. ..... 40/651
5,111,606 A * 5/1992 Reynolds ..... 40/661.02
5,348,485 A * 9/1994 Briechle et al. ..... 439/110
5,575,100 A * 11/1996 Marvin et al. ..... 40/642.02
5,816,550 A * 10/1998 Watanabe et al. ..... 248/222.11
5,847,378 A * 12/1998 Goodwin, III ..... 235/383
6,438,882 B1 * 8/2002 Reynolds ..... 40/642.02
6,581,316 B2 * 6/2003 Forsythe et al. ..... 40/657
6,715,675 B1 * 4/2004 Rosenfeld ..... 235/383

* cited by examiner

*Primary Examiner* — Joanne Silbermann
*Assistant Examiner* — Shin Kim
(74) *Attorney, Agent, or Firm* — Paul W. Martin

(57) ABSTRACT

An electronic shelf label with internal information which may be used all locations, including wet locations. The electronic shelf label includes a housing including a substantially transparent portion containing an aperture and an inner surface, a display in the housing for displaying information about an item associated with the electronic shelf label, wherein the display is visible through the aperture, and a layer of material adjacent the inner surface for conveying information about the item.

20 Claims, 3 Drawing Sheets

ELECTRONIC SHELF LABEL WITH INTERNAL INFORMATION

BACKGROUND OF THE INVENTION

The present invention relates to electronic shelf labels, and more specifically to an electronic shelf label with internal information.

Electronic shelf label customers may apply an overlay on the outer surface of an electronic shelf label to convey product information. However, use of overlays is undesirable in wet locations, such as produce storage areas.

Therefore, it would be desirable to provide an electronic shelf label with internal information.

SUMMARY OF THE INVENTION

In accordance with the teachings of the present invention, an electronic shelf label with internal information is provided.

The electronic shelf label includes a housing including a substantially transparent portion containing an aperture and an inner surface, a display in the housing for displaying information about an item associated with the electronic shelf label, wherein the display is visible through the aperture, and a layer of material adjacent the inner surface for conveying information about the item.

It is accordingly an object of the present invention to provide an electronic shelf label with internal information.

It is another object of the present invention to provide an electronic shelf label with internal coloring different than the coloring of other electronic shelf labels.

BRIEF DESCRIPTION OF THE DRAWINGS

Additional benefits and advantages of the present invention will become apparent to those skilled in the art to which this invention relates from the subsequent description of embodiments and the appended claims, taken in conjunction with the accompanying drawings, in which:

DETAILED DESCRIPTION

Figure 1:
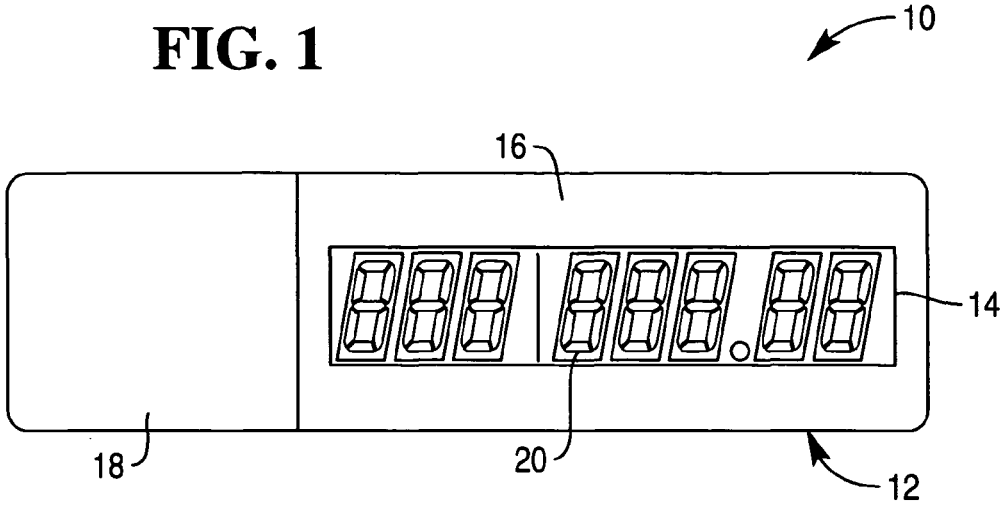
FIG. 1 is a diagram of an electronic shelf label.

Referring now to FIG. 1, electronic shelf label 10 includes housing 12.

Housing contains display 20 and electronic communications and control circuitry. Display 20 displays prices and other information about an item associated with electronic shelf label 10.

Housing includes portion 16 which contains aperture 14. Aperture 14 exposes display 20.

Housing may also include portion 18 which contains information about the item. The information may include basic product specifics such as brand, product name, size, and pack count.

Figure 2:
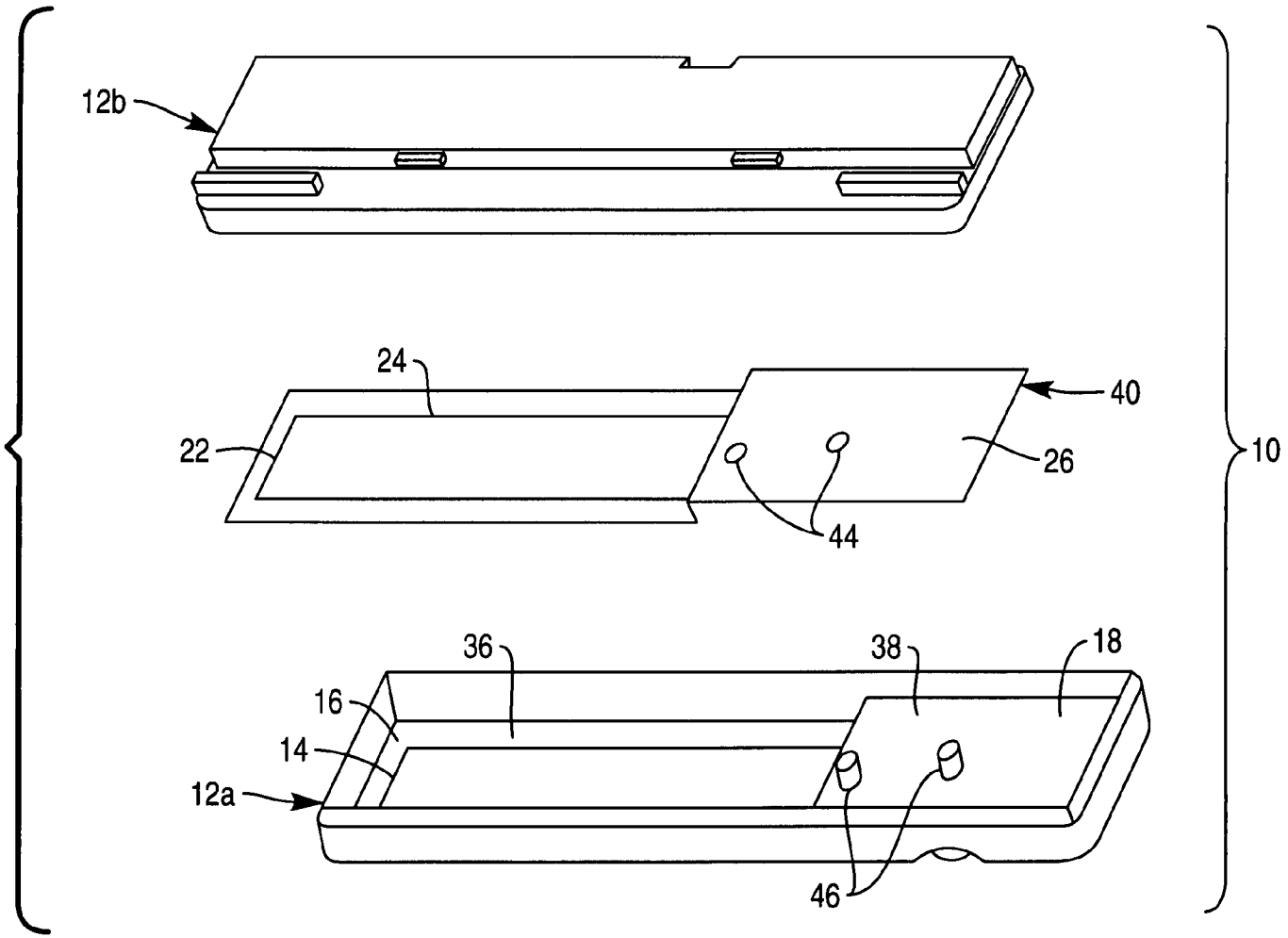
FIG. 2 is an exploded view illustrating relevant components of the electronic shelf label and an example internal layer.
Figure 3:
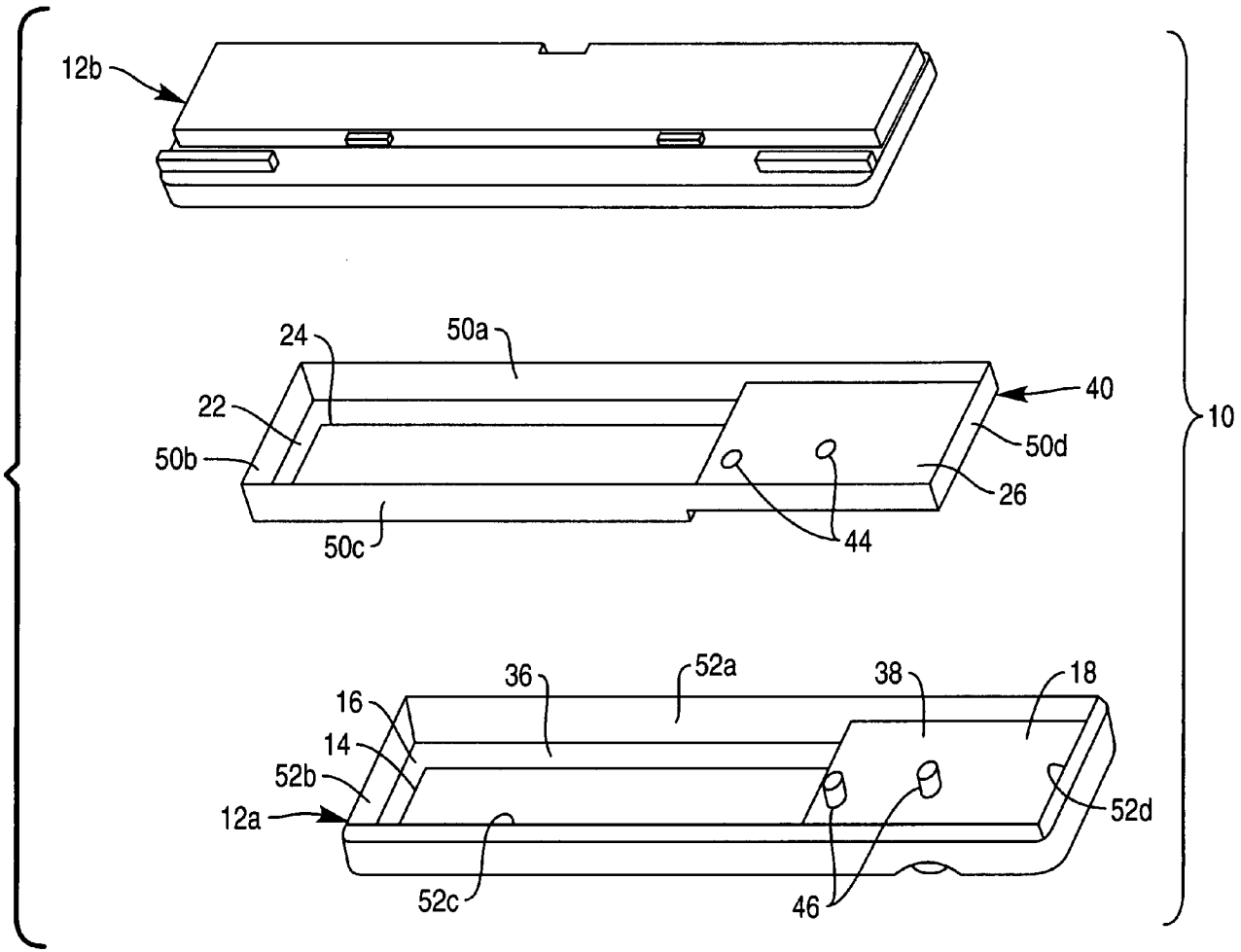
FIG. 3 is another exploded view illustrating relevant components of the electronic shelf label and another example internal layer.

Turning now to FIGS. 2 and 3, housing 12 further includes front housing portion 12*a* and rear housing portion 12*b*.

Rear housing portion 12*b* includes electronic communication and control circuitry, and display 20.

Front and rear housing portions 12*a* and 12*b* snap together to seal housing 12. Front housing portion 12*a* and rear housing portion 12*b* may be made of plastic. At least front housing portion 12*a* is substantially transparent.

Front housing portion 12*a* includes inner surfaces 36 and 38. Inner surface 36 is a display surface associated with portion 16. Inner surface 38 is a promotional surface associated with portion 18.

Electronic shelf label 10 further includes layer 40. Layer may include an insert made of paper, plastic, wood, synthetic films (e.g., DuPont Mylar® films, or any material that creates a different appearance than clear plastic. Layer 40 is dimensioned to have a snug fit against portions 16 and 18. Layer 40 may be removable upon disassembly of housing 12.

Layer 40 may be printed with information about an item that is not displayed by display 20. Alternatively, layer 40 may contain no printing, just color. Layer 40 may additionally be colored differently than other layers 40 to distinguish electronic shelf label 10 from others. For example, some layers 40 may include white paper with or without printed information, while certain others may include green paper with or without printed information.

Front housing portion 12*a* and rear housing portion 12*b* snap together. Fastening and aligning posts 46 pass through apertures 44 in layer 40 before coupling to corresponding mounting holes in rear housing portion 12*b*.

In accordance with one example embodiment (FIG. 2), layer 40 includes portion 22 which is dimensioned to cover inner surface 36 of front housing portion 12*a* and portion 26 which is dimensioned to cover inner surface 38 of front housing portion 12*a*. Aperture 24 exposes display 20.

In accordance with another example embodiment (FIG. 3), layer 40 additionally includes sidewall portions 50*a*-50*d* to give side surfaces 52*a*-52*d* of electronic shelf label 10 an appearance of color.

Using layer 40 offers the advantage of being able to easily change information or color by changing layers 40.

In accordance with another example embodiment involving only color, paint may be applied to inner surfaces 36, 38, and 52*a*-52*d* to give a more permanent color to front housing portion 12*a*. This inside painting can be done by spraying, pad painting, or stencil painting.

Although the invention has been described with particular reference to certain embodiments thereof, variations and modifications of the present invention can be effected within the spirit and scope of the following claims.

What is claimed is:

1. An electronic shelf label comprising:

a housing including a substantially transparent portion containing an aperture and an inner surface;

electronic communication and control circuitry;

an electronic display in the housing for displaying price and other information about an item associated with the electronic shelf label, the electronic display presenting information communicated to the electronic shelf label, wherein the display is visible through the aperture; and a layer of material aligned with the substantially transparent portion and adjacent the inner surface for conveying information about the item associated with the electronic shelf label whereby said information is visible through the substantially transparent portion.

2. The electronic shelf label of claim 1, wherein the layer has a color different than other layers of other electronic shelf labels.

3. The electronic shelf label of claim 1, wherein the layer comprises a paint layer.

4. The electronic shelf label of claim 1, wherein the layer comprises an insert.

5. The electronic shelf label of claim 4, wherein the insert is made of paper.

6. The electronic shelf label of claim 4, wherein the insert is made of plastic.

7. The electronic shelf label of claim 4, wherein the insert is made of wood.

8. The electronic shelf label of claim 4, wherein the insert is made of synthetic film.

9. The electronic shelf label of claim 1, wherein the layer is removable to change information about the item associated with the electronic shelf label.

10. The electronic shelf label of claim 1, wherein the inner surface comprises a display surface containing the aperture.

11. The electronic shelf label of claim 1, wherein the inner surface comprises a side surface.

12. The electronic shelf label of claim 1, wherein the layer includes printed information.

13. The electronic shelf label of claim 1, wherein the housing comprises front and rear housing portions which snap together to seal the housing.

14. The electronic shelf label of claim 13, wherein the front housing portion is transparent and said layer has a color to distinguish the electronic shelf label from other electronic shelf labels.

15. An electronic shelf label comprising:

a housing including a substantially transparent portion including an inner surface having an aperture therethrough;

electronic communication and control circuitry;

an electronic display in the housing for displaying price and other information about an item associated with the electronic shelf label, the electronic display presenting information communicated to the electronic shelf label, wherein the display is visible through the aperture; and an insert aligned with the substantially transparent portion and adjacent the inner surface for conveying information about the item associated with the electronic shelf label which is visible through the substantially transparent portion.

16. The electronic shelf label of claim 15, wherein the insert includes printed information.

17. The electronic shelf label of claim 15, wherein the insert has a color different than other layers of other electronic shelf labels.

18. The electronic shelf label of claim 15, wherein the insert is removable.

19. The electronic shelf label of claim 15, wherein the insert is a sheet of paper.

20. The electronic shelf label of claim 19, wherein the substantially transparent portion further comprises additional inner surfaces which are side surfaces, and wherein the insert further comprises side portions facing the side surfaces.

* * * * *